US007740419B2

(12) United States Patent
Nakakuma

(10) Patent No.: US 7,740,419 B2
(45) Date of Patent: Jun. 22, 2010

(54) METHOD FOR IMPROVING SOFT GROUND

(75) Inventor: Kazuyoshi Nakakuma, Saitama (JP)

(73) Assignee: Maruyama Kougyo Kabushikikaisha, Saitama (JP)

( * ) Notice: Subject to any disclaimer, the term of this patent is extended or adjusted under 35 U.S.C. 154(b) by 689 days.

(21) Appl. No.: 11/602,042

(22) Filed: Nov. 20, 2006

(65) Prior Publication Data

US 2007/0127988 A1 Jun. 7, 2007

Related U.S. Application Data

(63) Continuation-in-part of application No. PCT/JP2005/009092, filed on May 18, 2005.

(51) Int. Cl.
*E02D 3/10* (2006.01)

(52) U.S. Cl. ..... 405/271; 405/263; 405/36

(58) Field of Classification Search ..... 405/36, 405/43, 45, 258.1, 263, 266, 270, 271
See application file for complete search history.

(56) References Cited

U.S. PATENT DOCUMENTS 3,371,492 A * 3/1968 Tadashi Mise et al. ..... 405/50
3,919,849 A * 11/1975 Hessert et al. ..... 405/264
4,309,129 A * 1/1982 Takahashi ..... 405/269

FOREIGN PATENT DOCUMENTS

WO WO 2005/113901 * 5/2005

* cited by examiner

*Primary Examiner*—John Kreck
(74) *Attorney, Agent, or Firm*—Hiroe & Associates; Taras P. Bemko

(57) ABSTRACT

A method of improving soft ground, capable of effectively restricting settlement of a peripheral part of ground to be improved involved in improvement of the soft ground. A vertical supply path is formed by placing a vertical drain material in ground in the periphery of ground to be improved, and water containing a water stop material is charged in the vertical supply path to supply the water containing the water stop material to the ground through the vertical supply path. Then the water stop material charged in the vertical supply path follows a water flow and spreads in the periphery of the vertical supply path to form a water stop zone. The water stop zone formed by the water stop material prevents the movement of ground water in the ground and restricts lowering of the ground water in the ground caused by forced drainage from ground to be improved, effectively restricting settlement of the ground involved in improvement of soft ground.

30 Claims, 17 Drawing Sheets

METHOD FOR IMPROVING SOFT GROUND

CROSS REFERENCE TO RELATED APPLICATIONS

This is a Continuation-In-Part Application of International Application No. PCT/JP2005/009092, filed on 18 May 2005. Priority under 35 U.S.C. §119(a) and 35 U.S.C. §365(b) is claimed from Japanese Application Nos. JP2004-149950, filed 20 May 2004, JP2004-258081, filed 6 Sep. 2004, JP2004-313239, filed 28 Oct. 2004, and JP2004-340276, filed 25 Nov. 2004, the disclosures of which are also incorporated herein by reference.

TECHNICAL FIELD

The present invention relates to a method for improving soft ground which is appropriate for soft ground in reclaimed areas around lakes and swamps, for example. In particular, the invention relates to a method for improving soft ground according to which lowering of the groundwater level in the peripheral area of improved ground accompanying improvement of soft ground can be effectively prevented.

BACKGROUND TECHNOLOGY

According to conventional methods for improving soft ground, the upper surface of soft ground to be improved (hereinafter referred to as ground to be improved) is coated with an airtight sheet, and the above described ground to be improved is then subjected to vacuum pressure, so that an area of reduced pressure which is separated from the peripheral area of the ground to be improved is created in the above described ground to be improved, and an embankment is laid on the soft ground, and thus, the load of the embankment having high density is applied, and thereby, the soft ground is converted to hard ground.

Concretely, as shown in FIG. 17, vertical draining members 1 are driven into ground to be improved A at predetermined intervals, and then, a horizontal drain 2 is placed on top so as to make contact of the upper end portions la of these vertical draining members 1, and a water collecting pipe 3 which is linked to a vacuum pump 5 is connected to this horizontal draining member 2 via a vacuum tank 4, and furthermore, the upper surface of the ground to be improved A is coated with an airtight sheet 7, together with the upper end portions la of the above described vertical draining members 1, the horizontal draining members 2 and the water collecting pipe 3. After this, the vacuum pump 5 which is connected to the above described water collecting pipe 3 via the vacuum tank 4 is operated.

As a result, vacuum pressure is conveyed from the vacuum pump 5 to the ground to be improved A via the horizontal draining member 2 and the vertical draining members 1 so that the ground in areas surrounding each vertical draining member 1 with the vertical draining members 1 at the center is converted to regions of reduced pressure (hereinafter referred to as reduced pressure regions).

The vacuum pressure is conveyed from the ground surrounding the vertical draining members 1, which has become reduced pressure regions, to surrounding ground further on the outside, and as a result of this, pressure is created in the ground (water pressure, soil pressure) toward the vertical draining members 1.

Pore water included in the ground surrounding the vertical draining members 1 is sucked toward the vertical draining members 1 when this pressure is created in the ground, and water is discharged through the vertical draining members 1, the horizontal draining member 2 and the water collecting pipe 3, which form a water discharging path, and together with this, the ground further around the outside of the ground around the vertical draining members 1 also becomes reduced pressure regions.

In this manner, reduced pressure regions spread to the ground surrounding the vertical draining members 1 with the vertical draining members 1 at the center, and shortly thereafter, the entire region of the ground to be improved A becomes a reduced pressure region, and at the same time, the density and strength increase with the vertical draining members 1 at the center, so that the density and the strength increase in the entire region of the ground to be improved A.

As described above, the ground is converted to hard ground while a mound 6 is created on top of the airtight sheet 7, and thereby, the ground to be improved A is pressed by the load of the created mound 6, so that the density increases and water is removed, and the above described suction of water due to the difference in pressure works together, and thus, the density increases and the ground to be improved A settles (see Patent Document 1).

Patent Document 1: Japanese Patent No. 3270968 (see claims 1 and 2, as well as FIG. 7)

DISCLOSURE OF THE INVENTION

Problem to Be Solved by the Invention

In accordance with the above described pressure and density increasing water draining method, however, the underground water in the ground to be improved is forcefully discharged through vacuum pressure, and in the case where a sand layer or an organic soil layer having high water permeability exists within the ground in such a manner as to cut through the ground to be improved and the peripheral portion of the ground to be improved, the underground water in the peripheral portion B around the ground to be improved is also forcefully discharged, as shown by the arrows in FIG. 17, and thus, the underground water in the peripheral portion around the ground to be improved also improves, and this accelerate the increase in pressure and density due to the weight of soft peripheral ground in such a manner as to induce settling.

In the case of settling caused by discharging of underground water, the affected range expands as time passes, which works negatively in the pressure and density increasing water draining method, which requires sufficient time for increasing the density, in order to maintain the quality of the ground to be improved, and therefore, measures for reducing the effects outside of the ground to be improved as much as possible become necessary.

The present invention is provided in view of this technical problem, and an object thereof is to provide a method for improving soft ground according to which underground water in the peripheral portion around the ground to be improved can be effectively prevented from settling as the soft ground is improved.

Means for Solving Problem

In order to achieve the above described object, the gist of the invention according to claims 1 to 14 is a method for improving soft ground according to which a reduced pressure region that is isolated from the peripheral portion of the ground to be improved is created using vacuum pressure within the ground to be improved, so that pore water in the above described ground to be improved is discharged, and thereby, the above described ground to be improved is converted to hard ground (hereinafter simply referred to as improving method), characterized in that a vertical supply path is created in the above described ground to be improved and/or in the ground in the peripheral portion around the ground to be improved, and water containing a water sealing agent is supplied in this vertical supply path, so that the water containing a water sealing agent is supplied to the ground to be improved and/or the ground in the peripheral portion around the ground to be improved through the above described vertical supply path.

The gist of the invention according to claims 15 to 30 is an improving method characterized in that a vertical supply path is created in the ground in the peripheral portion around the ground to be improved, and a water sealing agent is supplied in this vertical supply path together with water, while a vertical water discharge path is created between the above described vertical supply path and the ground to be improved and/or outside the above described vertical supply path, so that water within the ground in the peripheral portion around the above described ground to be improved is discharged through this vertical water discharge path.

Effects of the Invention

In the improving method according to claims 1 to 14, a vertical supply path is created in the ground to be improved and/or in the ground in the peripheral portion around the ground to be improved, so that water containing a water sealing agent can be supplied to the ground to be improved and/or the ground in the peripheral portion around the ground to be improved through this vertical supply path, and therefore, the water sealing agent supplied in the above described vertical supply path spreads into the periphery of the vertical supply path following the water flow, and thus, a water sealing zone is formed.

The water sealing zone formed by the water sealing agent blocks the movement of underground water within the ground to be improved and/or the ground in the peripheral portion around the ground to be improved, and thus, prevents underground water within the ground in the peripheral portion around the ground to be improved from settling accompanying the forceful discharge of underground water from the ground to be improved, and thus, effects are gained such that ground in the peripheral portion around the ground to be improved can be effectively prevented from settling as the ground is improved.

In the improving method according to claims 15 to 30, a water sealing agent is supplied in the vertical supply path created within the peripheral ground together with water, while a vertical water discharge path is created between the above described vertical supply path and the ground to be improved and/or outside the above described vertical supply path, so that water is discharged from the ground in the peripheral portion around the above described ground to be improved through this vertical water discharge path, and therefore, the water sealing agent supplied in the vertical supply path spreads following the water flow from the vertical supply path to the vertical water discharge path, so that a water sealing zone is formed in within the ground in the peripheral portion around the ground to be improved.

The water sealing zone formed by the water sealing agent blocks the movement of underground water within the ground in the peripheral portion around the ground to be improved, and prevents underground water within the ground in the peripheral portion around the ground to be improved from settling accompanying the forceful discharge of underground water from the ground to be improved, and thus, effects are gained such that ground in the peripheral portion around the ground to be improved can be effectively prevented from settling as the soft ground is improved.

In this improving method, the water sealing agent spreads together with the flow of water from the vertical supply path to the vertical water discharge path, and therefore, the water sealing zone can be formed smoothly and surely, and thus, quick effects of preventing ground in the peripheral portion around the ground to be improved from settling as the soft ground is improved can be expected.

Best Mode for Carrying Out The Invention

In the following, an improving method of the present invention is described in further detail using one embodiment shown in the drawings. The improving method according to claims 1 to 14 is described in the following. In this improving method, a reduced pressure region which is isolated from the peripheral portion around the ground to be improved is created in soft ground using vacuum pressure and pore water in the above described soft ground is discharged, and thereby, the above described soft ground is converted to hard ground.

The method for creating a reduced pressure region which is isolated from the peripheral portion around the ground to be improved in the ground to be improved using vacuum pressure is not particularly limited. The improving methods described in Japanese Patent No. 3270968 and Japanese Unexamined Patent Publication 2003-55951, for example, are preferable in that vacuum pressure can be applied to the ground to be improved more efficiently, so that improvement can be achieved more effectively than with conventional methods using a conventional sand mat.

The improving method described in Japanese Patent No. 3270968 is a method for creating a reduced pressure region which is isolated from the peripheral portion around the ground to be improved in the above described ground to be improved by covering the upper surface of the ground to be improved with an airtight sheet and applying vacuum pressure to the above described ground to be improved, and is provided with: the step of driving vertical draining members 11 into ground to be improved A at predetermined intervals with the upper portion remaining above ground, thereby creating a vertical water discharge wall in the ground A; the step of horizontally placing a horizontal drain 12 that is linked to a vacuum pump P on top so that it makes contact with the upper end portions 11*a* of the vertical drains; the step of covering the top of the ground A with an airtight sheet 13 together with the upper end portions 11*a*of the vertical draining members and the horizontal draining member 12; and the step of creating a state of vacuum pressure on the upper surface of the ground A by operating the vacuum pump 15 which is connected to the horizontal drain 12 via a water collecting pipe 14 and a vacuum tank (not shown).

In addition, as shown in Japanese Unexamined Patent Publication 2003-55951, when the ground is improved, pore water which is sucked out from the ground to be improved by creating a reduced pressure region in the ground to be improved by applying vacuum pressure may be discharged through a water discharge path other than the above described path for conveying vacuum pressure.

Concretely, as shown in FIG. 1, water discharge tanks 16 which are connected outside of the ground to be improved A are placed within the ground to be improved A, on the lower side of the water collecting pipe 14 which is connected to the respective vertical draining members 11 placed at predetermined intervals in the ground to be improved A via the horizontal draining member 12, and thereby, pore water collected in the above described water collecting pipe 14 is discharged into the above described water discharge tanks 16.

In this case, as shown in FIG. 1, it is desirable for the water collecting pipe 14 and the water discharge tanks 16 to be connected via separators 18 for separating water from air using gravity, so that pore water within the above described water collecting pipe 14 is led to the above described discharge tanks 16 through these separators 18. In addition, water discharge pumps 17 are built into the water discharge tanks 16, so that pore water within the above described water discharge tanks 16 is forcefully discharged to the outside of the ground to be improved A through the water discharge pipe 19 which is connected outside of the ground to be improved A, and thereby, more efficient water discharge becomes possible.

In addition, as shown in FIG. 1, when the ground is improved, the weight of a mound can be applied by creating a mound 20 on top of the soft ground A. The mound 20 is created on the airtight sheet 13. As a result, the weight of the mound 20 having high density efficiently makes the density higher and causes water to be removed in the ground to be improved A, which works together with suction of water due to the difference in pressure, and thus, the ground to be improved A is accelerated to settle through increase in the density.

The present invention is characterized in that a vertical supply path is created within the ground to be improved and/or ground in the peripheral portion around the ground to be improved (hereinafter referred to as peripheral ground), and water containing a water sealing agent is supplied in this vertical supply path so that water containing a water sealing agent is supplied to the ground to be improved and/or the peripheral ground through this vertical supply path in the above described improving method.

As described above, when the density is increased and water is removed from the ground to be improved A, which work together with suction of pore water due to the difference in pressure, so that the density is increased and the ground to be improved A settles, underground water is forcefully discharged from peripheral ground B other than the ground to be improved A, in the case where there is a sand layer or an organic soil layer C having high permeability which cuts through the ground to be improved A and the peripheral ground B, as shown in FIG. 2. Therefore, there is a risk that the effects may induce settling of the soft peripheral ground B.

In order to avoid such a situation, vertical supply paths are created in the ground to be improved and/or the peripheral ground, and water containing a water sealing agent is supplied in these vertical supply paths, according to the improving method of the present invention.

Concretely, as shown in FIGS. 1 to 3, a large number of vertical draining members 101 are driven into the peripheral ground B at predetermined intervals so as to surround the ground to be improved A, and vertical supply paths are created. In this case, it is desirable for the vertical supply paths to be created at a small distance from the ground to be improved A. Concretely, it may be created at approximately 1 m to 2 m from the ground to be improved A.

FIG. 5 shows the state when vertical supply paths are created by driving a large number of vertical draining members 101 into the ground to be improved A at predetermined intervals in portions bordering the peripheral ground B.

Here, it is not necessary for the vertical supply paths to be created in the peripheral ground B at predetermined intervals so as to surround the ground to be improved A, or for it to be created in the ground to be improved A in portions bordering the peripheral ground B at predetermined intervals, and they may be created collectively in portions within the ground to be improved A or within the peripheral ground B, where there is a risk that underground water in the peripheral ground B may be forcefully discharged as the ground is improved.

Here, FIGS. 1 to 3 and 5 show an example where vertical supply paths are created within the ground to be improved A or the peripheral ground B, but it may also be possible to create vertical supply paths within the ground to be improved A and within the peripheral ground B, depending on the type of ground to be improved A and the peripheral ground B, and the scale and the form of the sand layer or the organic soil layer c having high water permeability.

Any vertical draining member may be used as the vertical draining members 101, as long as it can form a path supplying water containing a water sealing agent in the direction of the depth of the ground to be improved A or the peripheral ground B, and concretely, vertical drain materials where a long, plastic net is used as a core material and a filter layer made of a fiber sheet, such as unwoven cloth, felt, textile or knit, is provided on the front and rear of this net can be cited. In this case, it is desirable for the filter layer of the vertical draining members 101 to be formed of a fiber sheet having holes which allow the water sealing agent 102 to pass.

Here, the vertical supply paths can be created in accordance with a method for providing pipes having a large number of holes (pipes with holes) which allow the water sealing agent 102 to pass in the direction of the depth within the ground to be improved A or the peripheral ground B, instead of driving the vertical draining members 101 into the ground.

In the water containing a water sealing material 102, which is supplied in the vertical supply paths (vertical drains 101 and pipes with holes) in the ground to be improved A and/or the peripheral ground B, hydrophilic gel made of polysaccharides, such as salts of which the main component is CMC or sodium alginate, may be in a state of suspension.

In the case where water containing a water sealing agent in such a state is supplied in the vertical supply paths 101, the above described water containing a water sealing agent may be supplied in the vertical supply path 101 via the supply pipe 109 from a water sealing agent tank 108 for storing water containing a water sealing agent (hydrophilic gel suspension), as shown in, for example, FIG. 4.

In this case, the hydrophilic gel suspension that is supplied in the vertical supply paths 101 via the supply pipe 109 from the water sealing agent tank 108 flows down through the vertical supply paths 101 as it is and flows out and spreads into the sand layer or organic soil layer C having high water permeability which exists so as to cut through the ground to be improved A and the peripheral ground B through the vertical drains 101 (or pipes with holes) following the momentum of water flow.

The water sealing agent 102 (hydrophilic gel) in the suspension that flows out and spreads into the sand layer or the organic soil layer C having high water permeability partially remains within the sand layer or the organic soil layer C, as shown in FIGS. 1 to 3, creating a partially clogged state in the holes, and thus, the degree of water flow lowers.

The water containing a water sealing agent 102 (hydrophilic gel) collects in gap portions (portions where no clogging occurs) in the sand layer or the organic soil layer C having high water permeability which is partially clogged, and passes through these gap portions at a higher rate. During this process, the water sealing agent 102 (hydrophilic gel) clogs the gap portions.

In this manner, the gap portions in the sand layer or the organic soil layer C having high water permeability are clogged one after the other by the water sealing agent 102 (hydrophilic gel), and soon afterwards, a water sealing zone 107 is formed of the water sealing agent 102 (hydrophilic gel) due to the effects of combination and overlapping under pressure within the sand layer or organic soil layer C having high water permeability, as shown in FIGS. 2, 3 and 5.

This water sealing zone 107 blocks the flow paths of underground water made of the sand layer or organic soil layer C having high water permeability which cut into the ground to be improved A and the peripheral ground B, and thus, a situation where underground water in the peripheral ground B settles due to the forceful discharge of water to improve the ground can be avoided.

Meanwhile, in the case where neither sand layer nor organic soil layer C having high water permeability exists so as to cut through the ground to be improved and the peripheral ground, or a middle gravel layer D exists above the sand layer or organic soil layer C having high water permeability, the water sealing agent 102 does not stay within the middle gravel layer D and moves toward the ground to be improved A side together with the water flow, even when water containing a water sealing agent 102 (hydrophilic gel suspension) passes through this middle gravel layer D.

The water sealing agent 102 (hydrophilic gel) which flows toward the ground to be improved A side together with the water flow through the middle gravel layer D which cuts into the ground to be improved A and the peripheral ground B reaches the vertical drains 11 which form vertical water discharge paths created within the ground to be improved A. In the form shown in the drawings, vertical draining members 11 formed of a filter layer having through which water sealing agent 102 (hydrophilic gel) of which the surface absorbs water and swells does not pass are adopted, and these are driven into the ground to be improved A, and thus, vertical water discharge paths are created. Therefore, the water sealing agent 102 (hydrophilic gel) that reaches vertical drains 11 together with the water flow is blocked by the filter layer on the surface of the vertical drains 11 and cannot enter into the vertical drains, and attaches to the surface of the vertical drains 11 due to pressure, thus clogging the filter layer on the surface of the vertical drains 11, and thus, a water sealing zone 107 is formed there.

The water sealing zone 107 formed on the filter layer on the surface of the vertical drains 11 functions to stop the flow of underground water within the middle gravel layer D which cuts through the ground to be improved A and the peripheral ground B in the vertical draining members 11 on the ground to be improved A side, and the flow path of the underground water within the middle gravel layer D which cuts through the ground to be improved A and the peripheral ground B is blocked by this water sealing zone 107, and thereby, such a situation that underground water in the peripheral ground B settles due to the forceful water discharge for improving the ground can be avoided.

Here, in the case where vertical draining members 11 which are formed of a filter layer having textile through which the water sealing agent 102 does not pass are adopted, and thus, a water sealing zone 107 is formed on the filter layer on the surface of the vertical drains 11, the water sealing agent 102 adheres only in a portion of the filter layer on the surface of the vertical drains 11 that have been driven into the ground to be improved A which corresponds to the middle gravel layer D and forms a water sealing zone 107 there, and therefore, the inherent function of the vertical drains 11 can be maintained in portions other than the portion which corresponds to the inside of the vertical drains 11 and the middle gravel layer D, and thus, there is no risk of there being harmful effects, such as permeation and ventilation becoming impossible.

When the water sealing agent 102 (hydrophilic gel) forms a water sealing zone 107 or induces a state of partial clogging, water does not move, and the supply of water containing a water sealing agent (hydrophilic gel suspension) that has been supplied up to that point becomes excessive.

At this time, a floating type check valve 110, provided within the vertical supply paths 101, rises together with the rise of the surface of the liquid accompanying the excessive supply of water containing a water sealing agent (hydrophilic gel suspension), and closes the supply opening (not shown) of the vertical supply path 101, and thus, blocks the supply of water containing a water sealing agent into the vertical supply path 101. When the supply of water containing the water sealing agent is blocked, the water containing the water sealing agent (hydrophilic gel suspension) that is supplied into a vertical supply path 101 via the supply pipe 109 from the water sealing agent tank 108 is not supplied into the vertical supply path 101 and returns to the water sealing agent tank 108 through a return pipe 109*a*.

Here, in the case of this form, the degree to which a state of partial clogging and formation of a water sealing zone are induced varies depending on the size of the water sealing agent (hydrophilic gel). Therefore, the type of ground or peripheral ground, the scale of improvement of the ground, the amount of underground water, the degree of pressure when the ground is improved and the like are collectively estimated, and it is desirable to control the size of the molecular weight to an appropriate size so as to adjust the size of the gel. In addition, in the case where a hydrophilic gel suspension is used as the water containing a water sealing material, the water sealing zone made of hydrophilic gel is formed as a result of the effects of overlapping and combining due to pressure, and therefore, the hydrophilic gel returns to a floating state when there is no longer a difference in the pressure, and thus, the original permeability of water is recovered after the improvement of the ground, and this is quite useful as a water sealing measure which barely affects the underground water environment over the long term.

Here, as the water sealing agent 102, a mixture of one or more types selected from among coarse sawdust, wood powder, rice husk, grains such as rice, barley, foxtail millet, Japanese millet, beans, common millet or the same grains crushed, bran and cereals created when the husk is removed from the above described grains, starch, clay, cross linked carboxymethylcellulose, cross linked polyacrylate, starch, clay, cement and acrylonitrile graft polymer, PVA-maleic acid copolymer and vinyl acetate-acrylate copolymer, which are highly water absorbent polymers of which the water absorbing ratio is 30 times to 1500 times can be used, in addition to the above described hydrophilic gel.

The water sealing agent, for example the above described coarse sawdust and wood powder, can be made to swell prior to being supplied, and can be supplied to the vertical supply paths 101 as a suspension using the apparatus and method shown in FIG. 4.

The water sealing agent, for example the above described coarse sawdust and wood powder, can be made to swell after being supplied. This is described in the following. FIG. 6 shows a form where a layer 111 made of gravel or rough sand is provided around the upper end portion of a vertical draining member 101 which is driven into the ground to be improved A and/or the peripheral ground B, and water containing a water sealing agent 102, for example coarse sawdust or wood powder, is supplied in this layer 111 made of gravel or rough sand. In the form shown in FIG. 6, a pipe (which may or may not have holes) or frame 112 having a diameter of 15 cm to 30 cm and a depth of approximately 10 cm to 30 cm is provided around the upper end portion of the vertical draining member 101, and earth and sand within the pipe or frame 112 is removed and the inside is again filled with sand or gravel, and thus, the layer 111 made of gravel or rough sand is provided around the upper end portion of the vertical draining member 101. A number of supply pipes 113 (which may or may not have holes) are inserted into the layer 111 made of gravel or rough sand, and water containing a water sealing agent 102 is supplied in these supply pipes 113.

As a result, the water containing a water sealing agent 102 which is supplied through the supply pipes 113 spreads throughout the entirety of the layer 111 made of gravel or rough sand, and the water containing a water sealing agent 102 is instantly supplied into the vertical draining member 101. That is to say, the layer 111 made of gravel or rough sand is provided around the upper end portion of the vertical draining member 101, and thereby, the portion which absorbs water is not limited to the portion around the upper end portion of the vertical draining member 101, and the entire layer 111 made of gravel or coarse sand becomes a water absorbing portion, and thus, the rate of water supply into the vertical draining member 101 dramatically increases.

Here, though FIG. 6 shows an example where a layer 111 made of gravel or rough sand is provided around the upper end portion of the vertical draining member 101 that has been driven into the ground to be improved A and/or the peripheral ground B, a layer made of gravel or rough sand may be provided around the upper end portion of a pipe having a large number of holes (pipe with holes) which is placed in the ground to be improved A and/or the peripheral ground B.

Pore water from the ground to be improved A may be made to contain a water sealing agent, so that water containing a water sealing agent is provided, and this water containing a water sealing agent can be supplied into the above described vertical supply path. In this case, a trench 115 (or pipe) which is connected to a water discharge pipe 19 for pore water from the ground to be improved A is connected to the upper end portion of the vertical drain 101 (or pipe), which is a vertical supply path created in the ground to be improved A and/or the peripheral ground B, so that the pore water is supplied from the ground to be improved A to the vertical drain 101 (or pipe) through this trench 115 (or pipe). At this time, the water sealing agent 102 is supplied into the trench 115 (or pipe) to which the pore water is discharged through the water discharge pipe 19.

In addition, though the supply of pore water into the vertical supply paths in the example shown in FIGS. 1 and 2 is natural water supply (water discharge), a pressure applying tank or a pump is placed within the water discharge pipe 19 or the trench 115 (or pipe), and thereby, pore water can be forcefully supplied (discharged) in the vertical supply paths.

As shown in FIGS. 1 to 3, the water containing a water sealing agent 102 which is supplied in the vertical supply paths flows down within the vertical drains 101 (or pipes with holes), which are vertical supply paths, and flows out and spreads into the sand layer or organic soil layer C having high water permeability which exists in such a manner as to cut through the ground to be improved A and the peripheral ground B through the vertical drains 101 (or pipes with holes) following the momentum of this water flow.

The water sealing agent 102 also flows down within the vertical draining members 101 (or pipes with holes) that form the vertical supply paths together with the flow of water, which flows out and spreads into the sand layer or organic soil layer C having high water permeability, and thus, flows out and spreads into the sand layer or organic soil layer C having high water permeability.

A portion of the water sealing agent 102 that flows out and spreads into the sand layer or organic soil layer C having high water permeability stays within the sand layer or organic soil layer C (may absorb water and swell here, depending on the type of water sealing agent 102), creating a state of partial clogging, and thus, the degree of water permeability lowers.

The water containing a water sealing agent 102 is concentrated in gap portions (portions where there is no clogging) in the sand layer or organic soil layer C having high water permeability which is partially clogged, and passes through these gap portions at a faster rate. During this process, the water sealing material 102 clogs the gap portions.

In this manner, the gap portions in the sand layer or organic soil layer C having high water permeability are clogged one after the other by the water sealing agent 102, and soon afterwards, a water sealing zone 107 is formed of the water sealing agent 102 within the sand layer or organic soil layer C having high water permeability, as shown in FIGS. 2, 3 and 5.

This water sealing zone 107 blocks the flow path of underground water made of the sand layer or organic soil layer C having high permeability which cuts through the ground to be improved A and the peripheral ground B, and such a situation that underground water in the peripheral ground B settles due to forceful discharge of water for improving the ground can be avoided.

Here, the water sealing agent 102 can have such a form that microorganisms are mixed in. In the case where such a water sealing agent 102 is used, the microorganisms multiply after the water sealing zone 107 is formed of the water sealing agent 102, so that colonies are formed between pieces of the water sealing agent 102 that forms the water sealing zone 107, reinforcing this water sealing zone 107.

Here, nutrition components for microorganisms can be added to the water containing a water sealing agent. In this case, a large amount of nutritious components are included in the water sealing zone 107 formed within the ground, and thus, multiplication of microorganisms which lived in the soil within the ground from the start or microorganisms which were mixed into the water sealing agent 102 accelerates, which greatly contributes to the formation of colonies between pieces of the water sealing agent 102 and reinforcement of the water sealing zone 107.

Next, the improving method according to claims 15 to 30 is described. Here, according to this improving method, reduced pressure regions at a distance from the peripheral portion of the ground to be improved are created in the soft ground using vacuum pressure, so that pore water in the above described soft ground is discharged, and thereby, the above described soft ground is converted to hard ground, in the same manner as in the improving method according to claims 1 to 9, and therefore, the description is omitted here. In addition, the type of water sealing agent and the method for supplying the water sealing agent in a vertical supply path are the same as in the above described improving method according to claims 1 to 9, and therefore, the description is omitted here.

The present invention is characterized in that a vertical supply path is created within the peripheral ground and water containing a water sealing agent is supplied in this vertical supply path, while a vertical water discharge path is created between the above described vertical supply path and the ground to be improved and/or outside the above described vertical supply path, so that water within the ground in the peripheral portion of the above described ground to be improved can be discharged through this vertical water discharge path in the above described improving method.

As described above, when the density increases and water is removed in the ground to be improved A, which works together with suction of pore water due to the difference in pressure, so that settling of the ground to be improved, where the density increases, accelerates, underground water in the ground in the periphery of the ground to be improved is forcefully discharged, in the case where the sand layer or organic soil layer having high water permeability exists in such a manner as to cut through the ground to be improved and the peripheral ground. Therefore, there is a risk that settling of soft peripheral ground may also be induced as a result of these effects.

In order to avoid such a situation, a vertical supply path is created at predetermined intervals in the peripheral ground, so that a water sealing agent can be supplied in this vertical supply path together with water in accordance with the improving method of the present invention. Concretely, as shown in FIGS. 7 to 12, a number of vertical draining members 101 are driven into the peripheral ground B at predetermined intervals in broken line form so as to surround the ground to be improved A, and thus, vertical supply paths are created. Any vertical draining member may be used as the vertical draining members 101, as long as it can form a path supplying water and a water sealing agent in the direction of the depth of the peripheral ground B, and concretely, vertical drain materials where a long, plastic net is used as a core material and a filter layer made of a fiber sheet, such as unwoven cloth, felt, textile or knit, is provided on the front and rear of this net can be cited. In this case, it is desirable for the filter layer of the vertical draining members 101 to be formed of a fiber sheet having holes which allow the water sealing agent 102 to pass.

Here, the vertical supply paths can be created by providing pipes having a large number of holes (pipes with holes) which allow the water sealing agent to pass in the direction of the depth within the peripheral ground B, instead of driving the vertical draining members 101 into the ground, or by providing a sand layer in pillar form within the peripheral ground B.

Here, it may not be necessary to create the vertical supply path at predetermined intervals so as to surround the ground to be improved A, depending on the type of peripheral ground B, and the vertical supply paths can be collectively created in only a portion where there is a risk that underground water in the peripheral ground B may be forcefully discharged as the ground is improved.

Here, it is desirable to create the vertical supply paths as far as possible from the ground to be improved A. Concretely, the vertical supply paths may be created at a small distance from the ground to be improved A, for example approximately 1 m to 2 m.

In addition, vertical water discharge paths are created between the vertical supply paths in the above described peripheral ground and the ground to be improved and/or outside the vertical supply paths. In the form shown in FIGS. 7 and 8, the vertical water discharge paths are created by driving a number of vertical draining members 103 in portions between the vertical supply paths (vertical drains 101) and the ground to be improved A at predetermined intervals in broken line form.

Any vertical draining member may be used as the vertical draining members 103, as long as it can form a water discharge path in the direction of the depth of the peripheral ground B, and concretely, vertical drain materials where a long, plastic net is used as a core material and a filter layer made of a fiber sheet, such as unwoven cloth, felt, textile or knit, is provided on the front and rear of this net can be cited. In this case, it is desirable for the filter layer of the vertical draining members 103 to be formed of a fiber sheet having textiles through which it is impossible or difficult for the water sealing agent 102 to pass. Here, the vertical water discharge paths can be created by providing pipes having no holes through which it is impossible for the water sealing agent to pass or having a large number of holes (pipes with holes) which makes it difficult for the water sealing agent to pass in the direction of the depth within the peripheral ground B, instead of driving the vertical draining members 103 into the ground, or by providing a sand layer in pillar form within the peripheral ground B.

In addition, a horizontal draining member 104 which is linked to a vacuum pump 105 is connected to the upper end of the vertical draining members 103 which form the vertical water discharge paths, and the top surface thereof is covered with an airtight sheet 106.

In addition, as shown in FIGS. 9 and 10, water containing a water sealing agent 102 is supplied in the vertical drains 101 that form the vertical supply paths and the vacuum pump 105 is operated, and thereby, the water flows down within the vertical drains 101, which are vertical supply paths, as shown by the arrows in FIGS. 9 and 10, and after that, flows through the sand layer or organic soil layer C having high water permeability which exists in the middle layer or the lower layer in the peripheral ground B, and furthermore, passes through the vertical draining members 103 which form the vertical water discharge paths created between the vertical supply paths (vertical drains 101) and the ground to be improved A so as to be discharged to the outside of the ground.

The water sealing agent 102 is carried by the flow of the water, which starts from the vertical draining members 101 which form the above described vertical water absorbing paths and passes through the sand layer or organic soil layer C having high water permeability and the vertical draining members 103 which form the vertical water discharge paths, and then, reaches the outside of the ground B so as to flow down the vertical draining members 101 which form the vertical supply paths, spread into the sand layer and organic layer C having high water permeability and reach the vertical draining members 103 which form the vertical water discharge paths.

A portion of the water sealing agent 102 contained in the water stays within the sand layer or organic soil layer C having high water permeability, thus creating a state of partial clogging within the sand layer or organic soil layer C having high water permeability, and the degree of water permeability lowers. The water containing a water sealing agent 102 collects in gap portions in the sand layer or the organic soil layer C having high water permeability which is partially clogged, and passes through these gap portions at a higher rate. During this process, the water sealing agent 102 clogs the gap portions.

In this manner, the gap portions in the sand layer or the organic soil layer C having high water permeability are clogged one after the other by the water sealing agent 102, and soon afterwards, a water sealing zone 107 is formed of the water sealing agent 102 within the sand layer or organic soil layer C having high water permeability, as shown in FIGS. 11 and 12.

This water sealing zone 107 blocks the flow paths of underground water made of the sand layer or organic soil layer C having high water permeability which cut into the ground to be improved A and the peripheral ground B, and thus, a situation where underground water in the peripheral ground B settles together with the forceful discharge of water to improve the ground can be avoided.

Meanwhile, in the case where no sand layer or organic soil layer C having high water permeability exists so as to cut through the ground to be improved and the peripheral ground, or a middle gravel layer D exists above the sand layer or organic soil layer C having high water permeability, the water sealing agent 102 does not stay within the middle gravel layer D and moves toward the vertical draining members 103 which form the vertical water discharge paths together with the water flow, even when water containing a water sealing agent 102 passes through this middle gravel layer D.

The water sealing member 102 which moves through the middle gravel layer D following the water flow within the middle gravel layer D is blocked by the filter layer having textiles through which it is impossible or difficult for the water sealing agent 102 to pass on the surface of the vertical draining members 103, cannot enter into the vertical draining members 103, and adheres to the surface of the vertical drains 11, clogging the filter layer on the surface of the vertical drains 11, and thus, a water sealing zone 107 is formed there.

The water sealing zone 107 formed on the filter layer on the surface of the vertical drains 103 functions to stop the flow of underground water within the middle gravel layer D which cuts through the ground to be improved A and the peripheral ground B in the vertical draining members 103 on the peripheral ground B side, and the flow path of the underground water within the middle gravel layer D which cuts through the ground to be improved A and the peripheral ground B is blocked by this water sealing zone 107, and thereby, such a situation that underground water in the peripheral ground B settles together with the forceful water discharge for improving the ground can be avoided.

In the form shown in FIGS. 13 and 14, vertical water discharge paths are created by driving a large number of vertical draining members 103*a* and 103*b* into portions between the vertical supply paths (vertical drains 101) in the peripheral ground B and the ground to be improved A as well as outside the vertical supply paths (vertical drains 101) at predetermined intervals in broken line form. Horizontal drains 104*a* and 104*b*, linked to vacuum pumps 105*a* and 105*b*, are connected to the upper end portions of the vertical draining members 103*a* and 103*b*, and the upper end portions of these vertical draining members 103*a* and 103*b* as well as the upper surface of the horizontal drains 104*a* and 104*b*, linked to the vacuum pumps 105*a* and 105*b*, are covered with an airtight sheet 106.

Thus, water containing a water sealing agent 102 is supplied in the vertical drains 101 which form the vertical supply paths, and the vacuum pumps 105*a* and 105*b*, linked to the horizontal drains 104*a* and 104*b* which are connected to the upper end portions of the vertical draining members 103*a* and 103*b*, are operated, and thereby, the water flows down within the vertical drains 101, which are the vertical supply paths as shown by the arrows in FIG. 13, and after that, the water passes through the sand layer or organic soil layer C having high water permeability, which exists in the middle layer or the lower layer in the peripheral ground B, and flows in the direction of the vertical draining members 103*a* which form the vertical water discharge paths created between the vertical supply paths (vertical drains 101) and the ground to be improved A, and in the direction of the vertical draining members 103*b* which form the vertical water discharge paths created outside of the vertical supply paths (vertical drains 101) so as to pass through the vertical draining members 103*a* and 103*b* which respectively form the vertical water discharge paths, and thus, the water is discharged to the outside of the ground B.

The water sealing agent 102 contained in the water is carried by the flow of the water, which starts from the vertical draining members 101 that form the above described vertical water absorbing paths, passes through the sand layer or organic soil layer C having high water permeability and the vertical draining members 103*a* and 103*b* that form the vertical water discharging paths, and reaches the outside of the ground B so as to flow down the vertical draining members 101 that form the vertical supply paths, spread into the sand layer or organic soil layer C having high water permeability, and reach the vertical draining members 103*a* and 103*b* that form the vertical water discharge paths.

The water sealing agent 102 partially stays within the sand layer or organic soil layer C having high water permeability, creating a state of partial clogging within the sand layer or organic soil layer C having high water permeability so that the degree of water permeability lowers. The water containing the water sealing agent 102 is concentrated on the gap portions in the sand layer or organic soil layer C having high water permeability, which is partially clogged, and passes through these gap portions at a faster rate. During this process, the gap portions are clogged by the water sealing agent 102.

In this manner, the gap portions in the sand layer or organic soil layer C having high water permeability are clogged one after the other by the water sealing agent 102, and soon afterwards, water sealing zones 107*a* and 107*b* are formed of the water sealing agent 102 that has absorbed water and swollen within the sand layer or organic soil layer C having high water permeability, as shown in FIG. 14.

In the case of this form, water sealing zones 107*a* and 107*b* are widely formed within the sand layer or organic soil layer C having high water permeability which cuts into the ground to be improved A and the peripheral ground B, and therefore, the flow path of the underground water which flows through the sand layer or organic soil layer C is blocked more completely.

FIGS. 15 and 16 show the form where vertical water discharge paths are created outside the vertical supply paths. In the form shown in FIGS. 15 and 16, the vertical water discharge paths are created by driving a large number of vertical draining members 103 into portions outside of the vertical supply paths (vertical drains 101) at predetermined intervals in broken line form.

Any vertical draining member may be used as the vertical draining members 103, as long as it can form a water discharge path in the direction of the depth of the peripheral ground B, and concretely, vertical drain materials where a long, plastic net is used as a core material and a filter layer made of a fiber sheet, such as unwoven cloth, felt, textile or knit, is provided on the front and rear of this net can be cited. In this case, it is desirable for the filter layer of the vertical draining members 103 to be formed of a fiber sheet having textiles through which it is impossible or difficult for the water sealing agent 102 to pass. Here, the vertical water discharge paths can be created by providing pipes having no holes through which it is impossible for the water sealing agent to pass or having a large number of holes (pipes with holes) which makes it difficult for the water sealing agent to pass in the direction of the depth within the peripheral ground B, instead of driving the vertical draining members 103 into the ground, or by providing a sand layer in pillar form within the peripheral ground B.

In addition, a horizontal draining member 104 which is linked to a vacuum pump 105 is connected to the upper end of the vertical draining members 103 which form the vertical water discharge paths, and the top surface thereof is covered with an airtight sheet 106.

In addition, as shown in FIGS. 15 and 16, water containing a water sealing agent 102 is supplied in the vertical drains 101 that form the vertical supply paths and the vacuum pump 105 is operated, and thereby, the water flows down within the vertical drains 101, which are vertical supply paths, as shown by the arrows in FIG. 15, and after that, flows through the sand layer or organic soil layer C having high water permeability which exists in the middle layer or the lower layer in the peripheral ground B, and furthermore, passes through the vertical drains 11 which form the vertical water discharge paths created within the ground to be improved A as well as the vertical draining members 103 which form the vertical water discharge paths created outside of the vertical supply paths (vertical drains 101) so as to be discharged to the outside of the ground.

The water sealing agent 102 contained in the water is carried by the flow of the water, which starts from the vertical draining members 101 which form the above described vertical water absorbing paths and passes through the sand layer or organic soil layer C having high water permeability, the vertical drains 11 which form the vertical water discharge paths created in the ground to be improved A and the vertical draining members 103 which form the vertical water discharge paths, and then, reaches the outside of the ground to be improved A and the outside of the ground B so as to flow down the vertical draining members 101 which form the vertical supply paths, spread into the sand layer and organic layer C having high water permeability and reach the vertical draining members 11 and 103 which form the vertical water discharge paths.

A portion of the water sealing agent 102 stays within the sand layer or organic soil layer C having high water permeability, thus creating a state of partial clogging within the sand layer or organic soil layer C having high water permeability, and the degree of water permeability lowers. The water containing a water sealing agent 102 collects in gap portions (portions where no clogging occurs) in the sand layer or the organic soil layer C having high water permeability which is partially clogged, and passes through these gap portions at a higher rate. During this process, the water sealing agent 102 clogs the gap portions.

In this manner, the gap portions in the sand layer or the organic soil layer C having high water permeability are clogged one after the other by the water sealing agent 102, and soon afterwards, a water sealing zone 107 is formed of the water sealing agent 102 within the sand layer or organic soil layer C having high water permeability, as shown in FIG. 16.

This water sealing zone 107 blocks the flow paths of underground water made of the sand layer or organic soil layer C having high water permeability which cut into the ground to be improved A and the peripheral ground B, and thus, a situation where underground water in the peripheral ground B settles together with the forceful discharge of water to improve the ground can be avoided.

Meanwhile, in the case where no sand layer or organic soil layer C having high water permeability exists so as to cut through the ground to be improved and the peripheral ground, or a middle gravel layer D exists above the sand layer or organic soil layer C having high water permeability, the water sealing agent 102 does not stay within the middle gravel layer D and moves toward the vertical drains 11 which form the vertical water discharge paths in the ground to be improved A and the vertical draining members 103 which form the vertical water discharge paths in the peripheral ground B together with the water flow, even when water containing a water sealing agent 102 passes through this middle gravel layer D.

The water sealing member 102 which moves through the middle gravel layer D following the water flow within the middle gravel layer D is blocked by the filter layer having textile which it is impossible or difficult for the water sealing agent 102 to pass on the surface of the vertical draining members 11 and 103 which form the vertical water discharge paths, cannot enter into the vertical draining members 11 and 103, and adheres to the surface of the vertical drains 11 and 103, clogging the filter layer on the surface of the vertical drains 11, and thus, a water sealing zone 107 is formed there.

The water sealing zone 107 formed on the filter layer on the surface of the vertical drains 103 functions to stop the flow of underground water within the middle gravel layer D which cuts through the ground to be improved A and the peripheral ground B in the vertical drains 11 on the ground to be improved A side and in the vertical draining members 103 on the peripheral ground B side, and the flow path of the underground water within the middle gravel layer D which cuts through the ground to be improved A and the peripheral ground B is blocked by this water sealing zone 107, and thereby, such a situation that underground water in the peripheral ground B settles together with the forceful water discharging paths for improving the ground can be avoided.

Here, the examples shown in the above described embodiments are merely illustrative, and may be freely modified within the scope of the claims, for example by providing dual lines or triple lines along which vertical water discharge are created around the peripheral portion B of the ground to be improved, depending on the type of ground in the peripheral portion B of the ground to be improved.

EXPLANATION OF SYMBOLS

Figure 1:
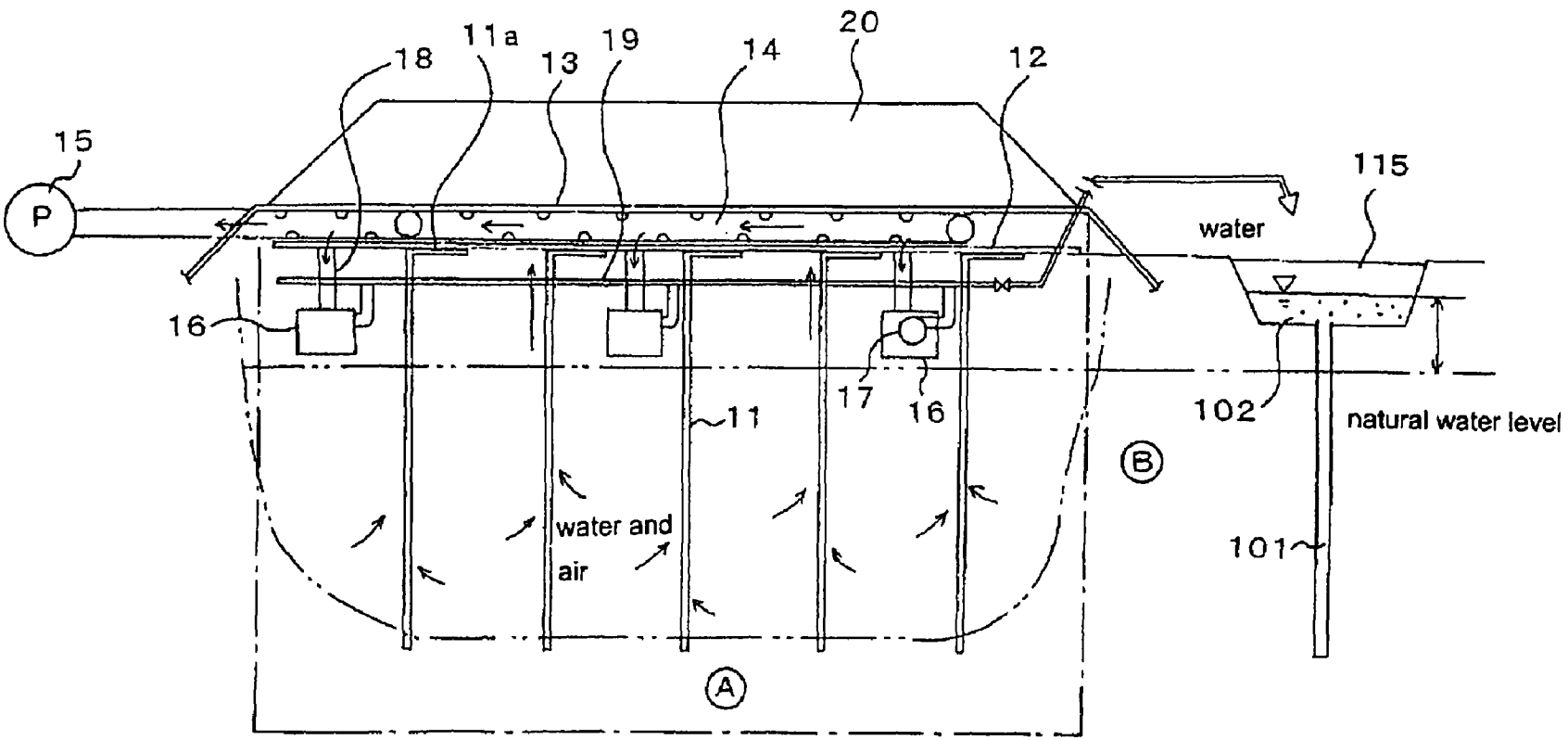
FIG. 1 is a schematic cross sectional diagram showing an example where an improving method of the present invention is applied.
Figure 2:
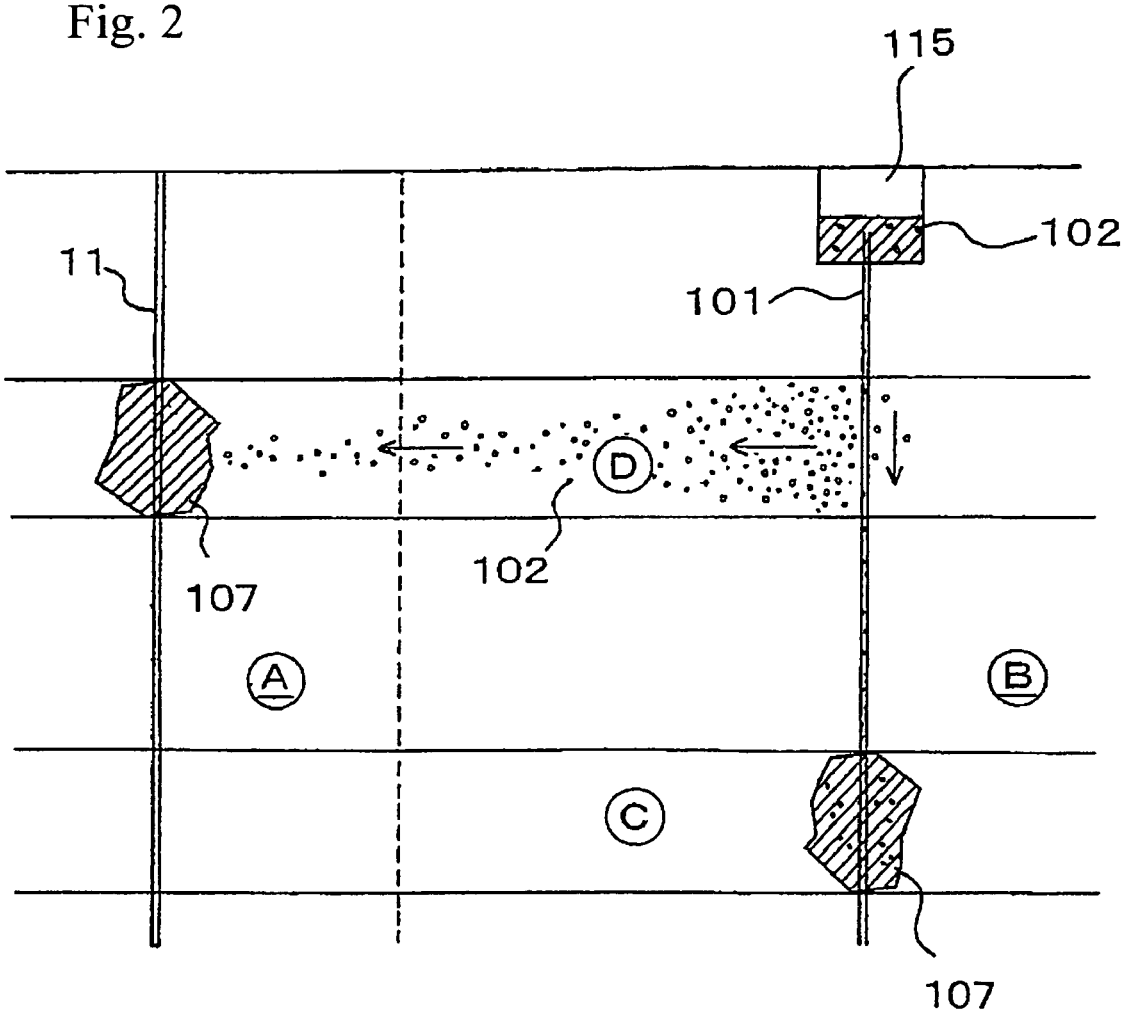
FIG. 2 is a schematic cross sectional diagram showing vertical supply paths.
Figure 3:
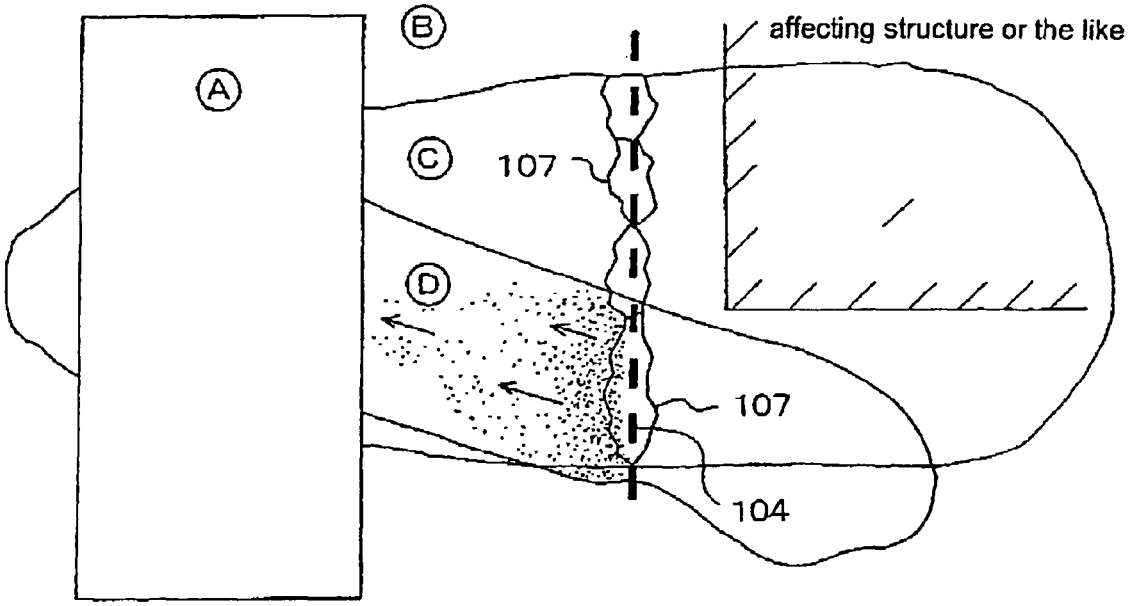
FIG. 3 is a schematic plan diagram showing the same vertical supply paths.
Figure 4:
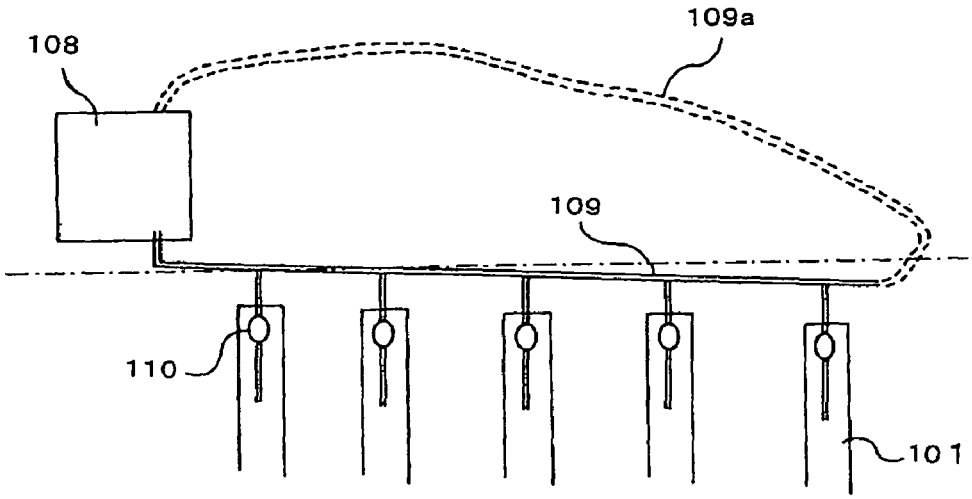
FIG. 4 is a schematic diagram showing a system for supplying water containing a water sealing agent.
Figure 5:
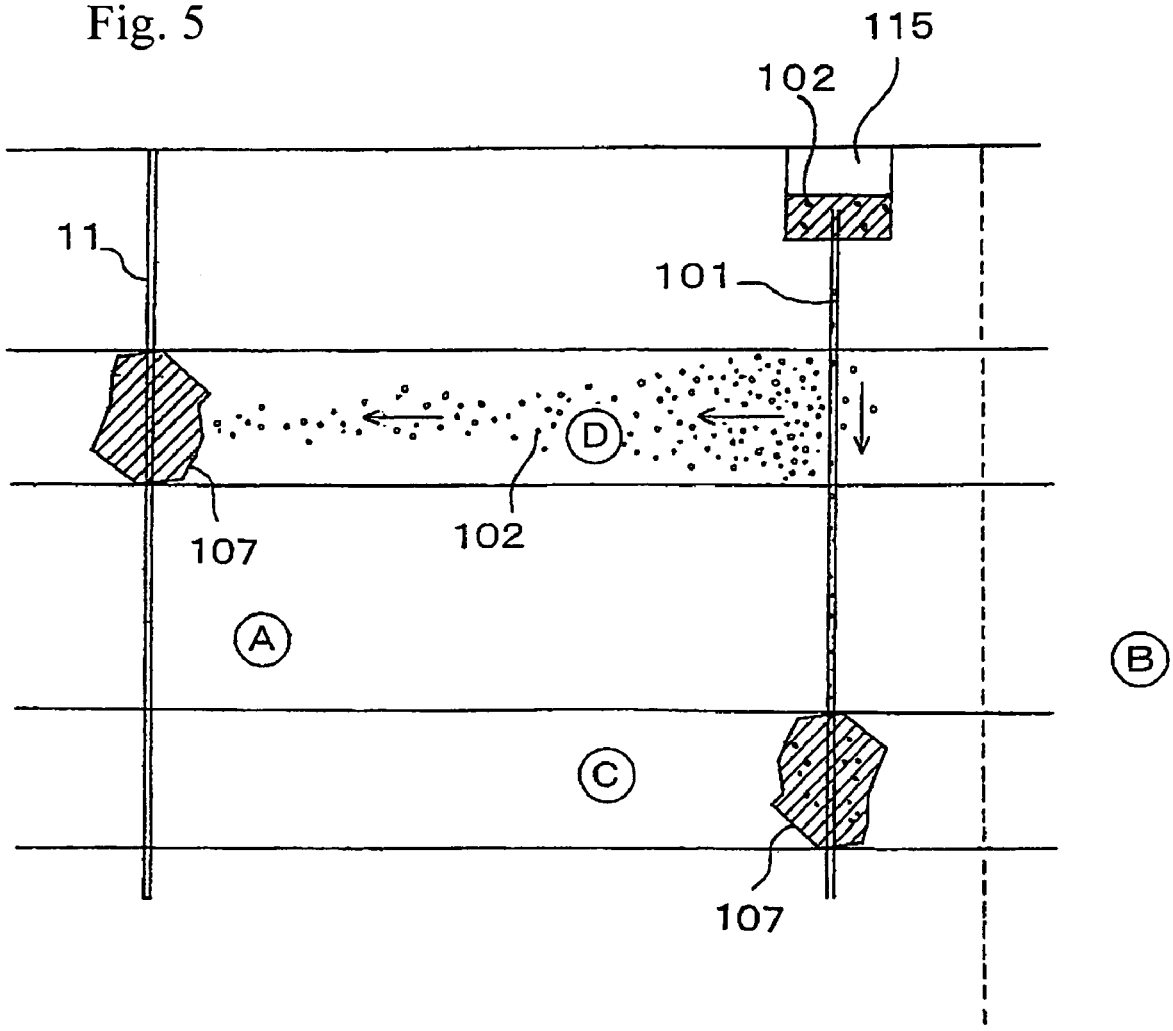
FIG. 5 is an enlarged perspective diagram showing the main portion of an example where a sand layer is provided around the upper end portion of vertical draining members which have been driven into the ground to be improved and/or the peripheral ground.
Figure 6:
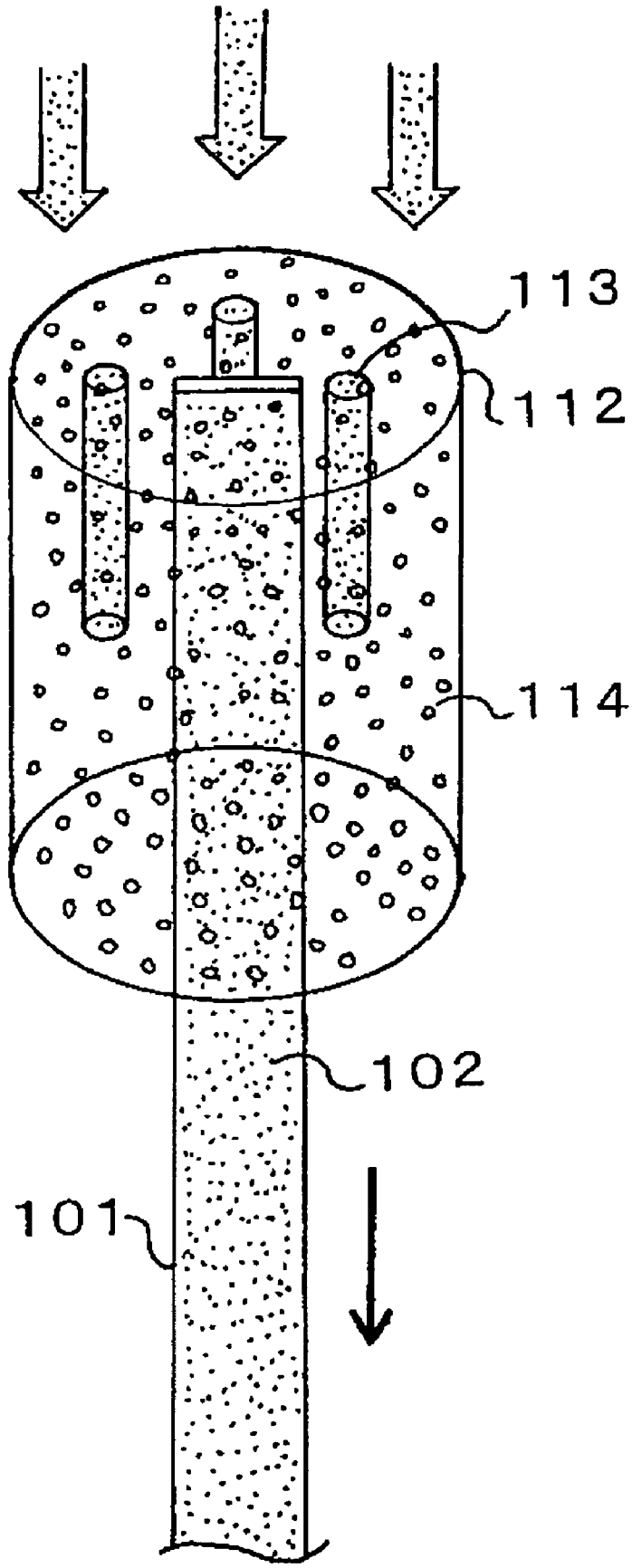
FIG. 6 is a schematic cross sectional diagram showing another example of a vertical supply path.
Figure 7:
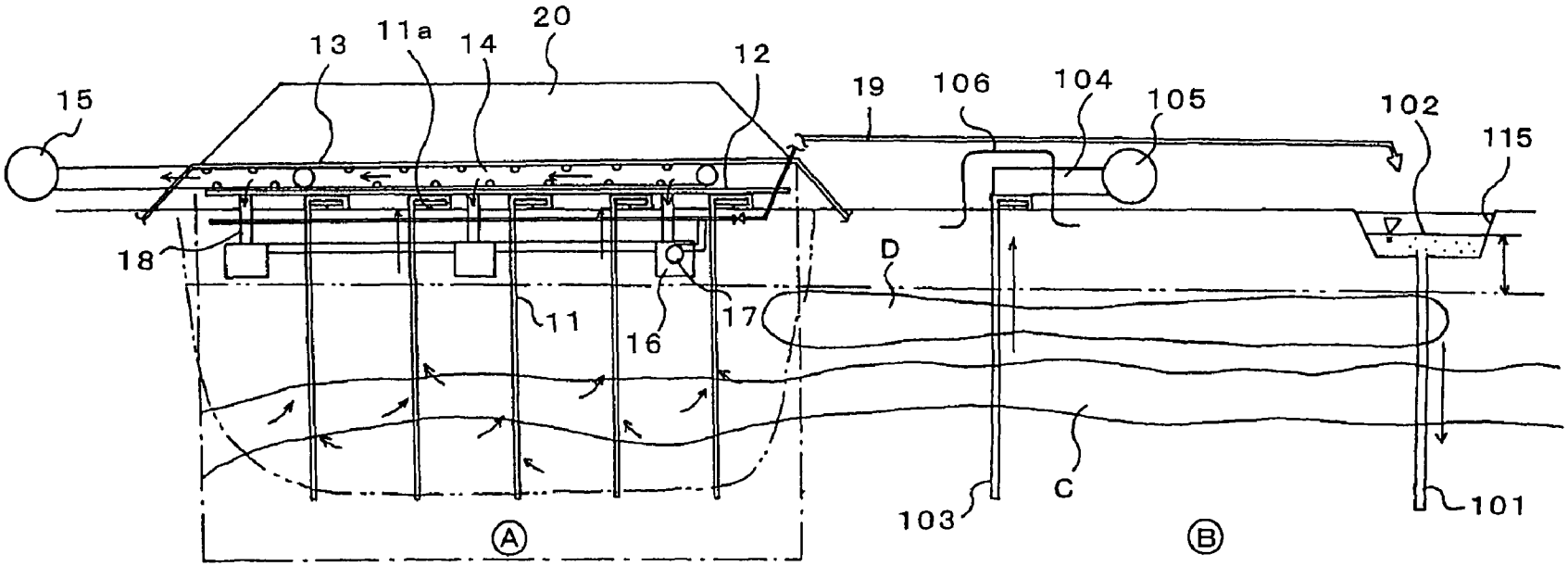
FIG. 7 is a schematic cross sectional diagram showing an example where an improving method of the present invention is applied.
Figure 8:
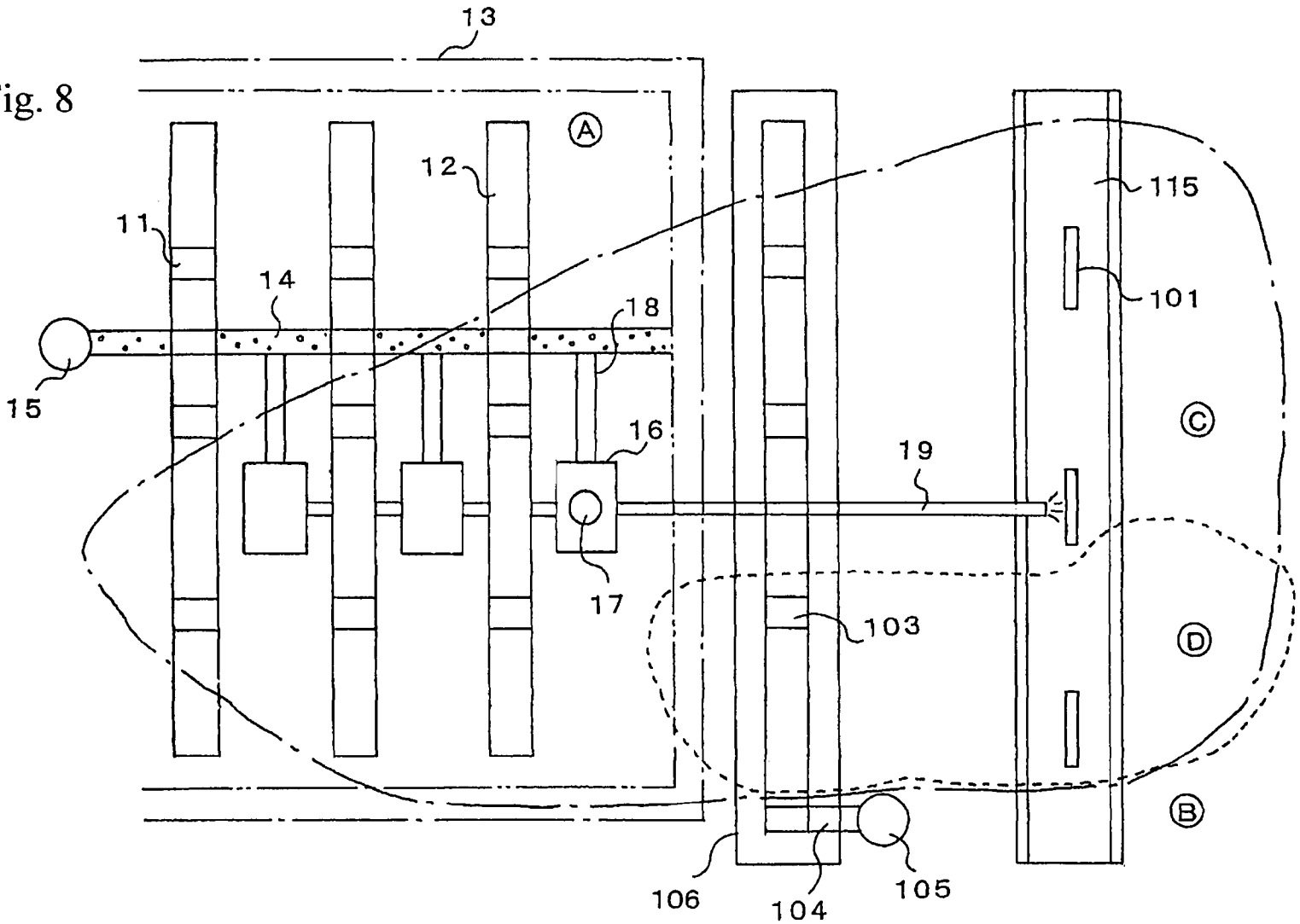
FIG. 8 is a schematic plan diagram of the same example as in FIG. 7.
Figure 9:
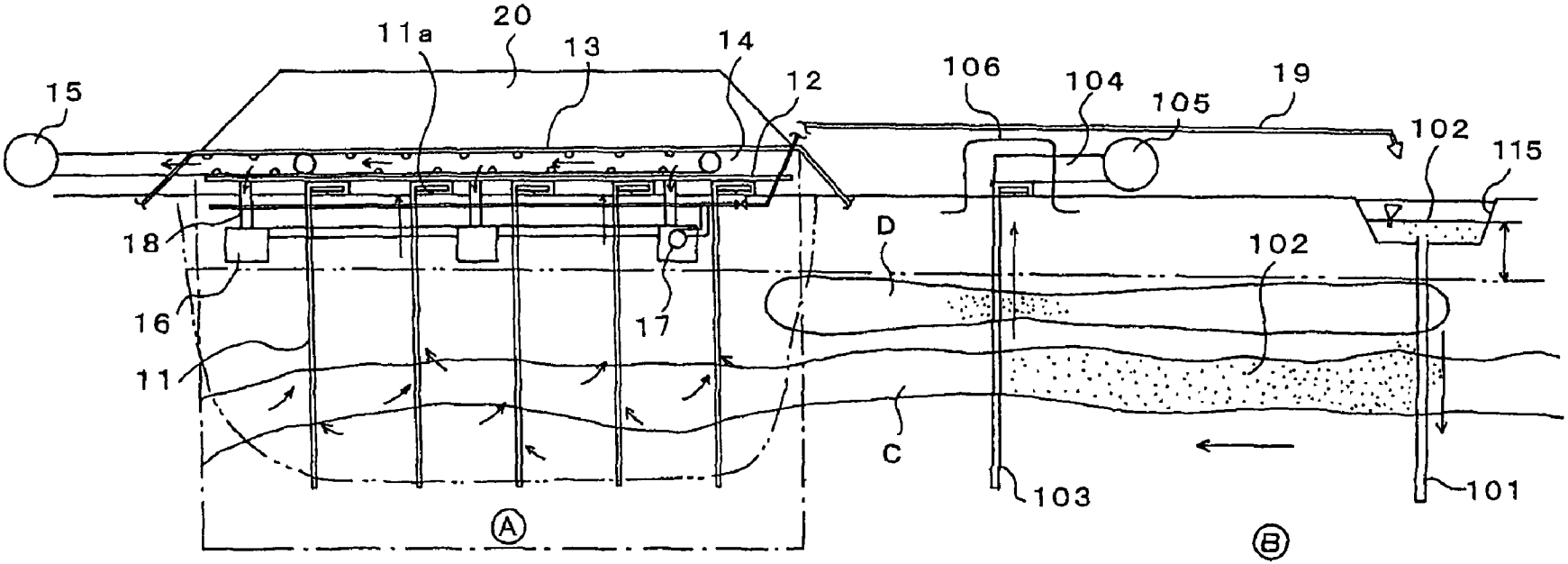
FIG. 9 is a schematic cross sectional diagram showing the flow of water and a water sealing agent which is created by supplying the water sealing agent into vertical drains together with water and operating a vacuum pump.
Figure 10:
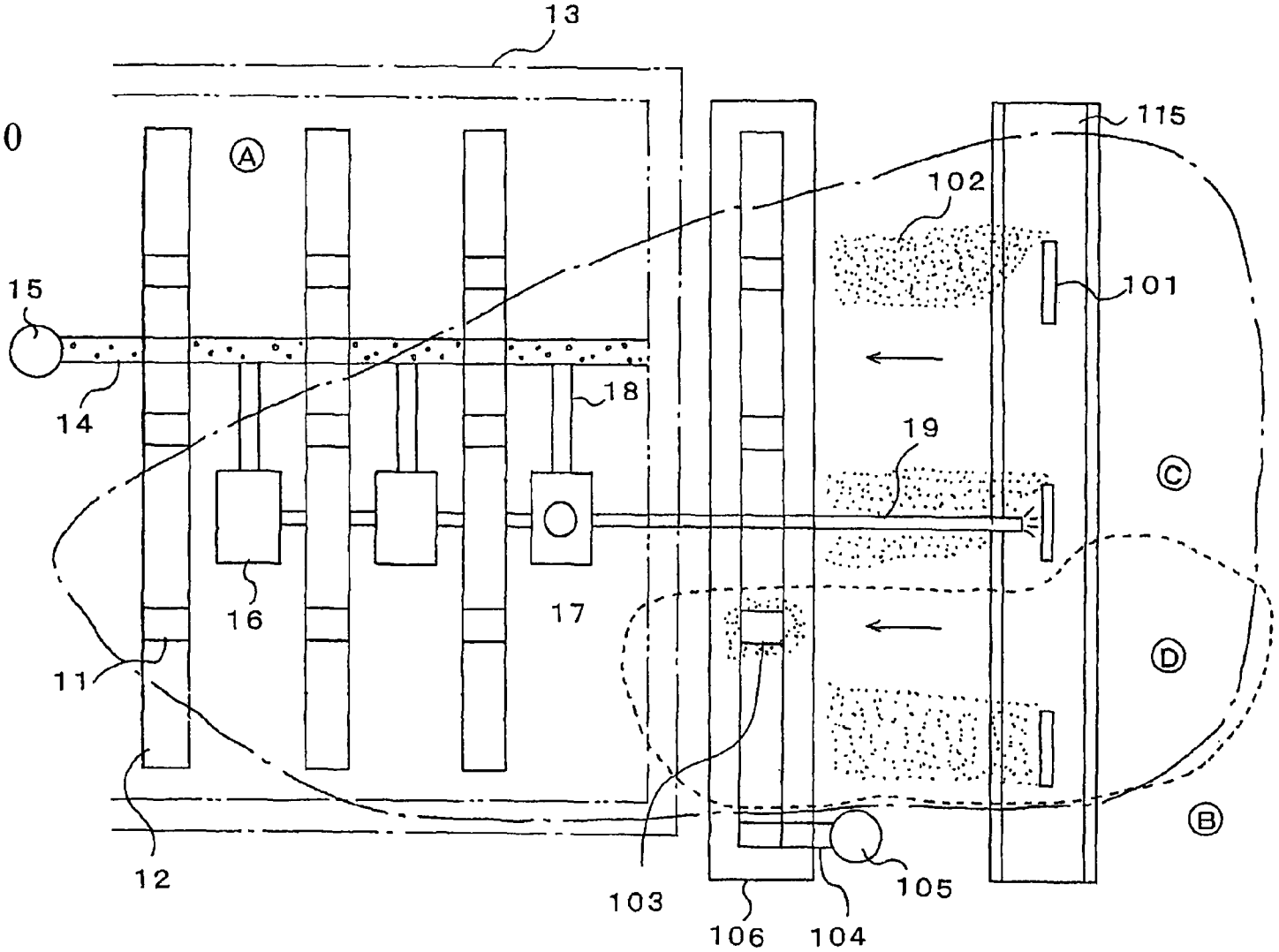
FIG. 10 is a schematic plan diagram showing the same as FIG. 9.
Figure 11:
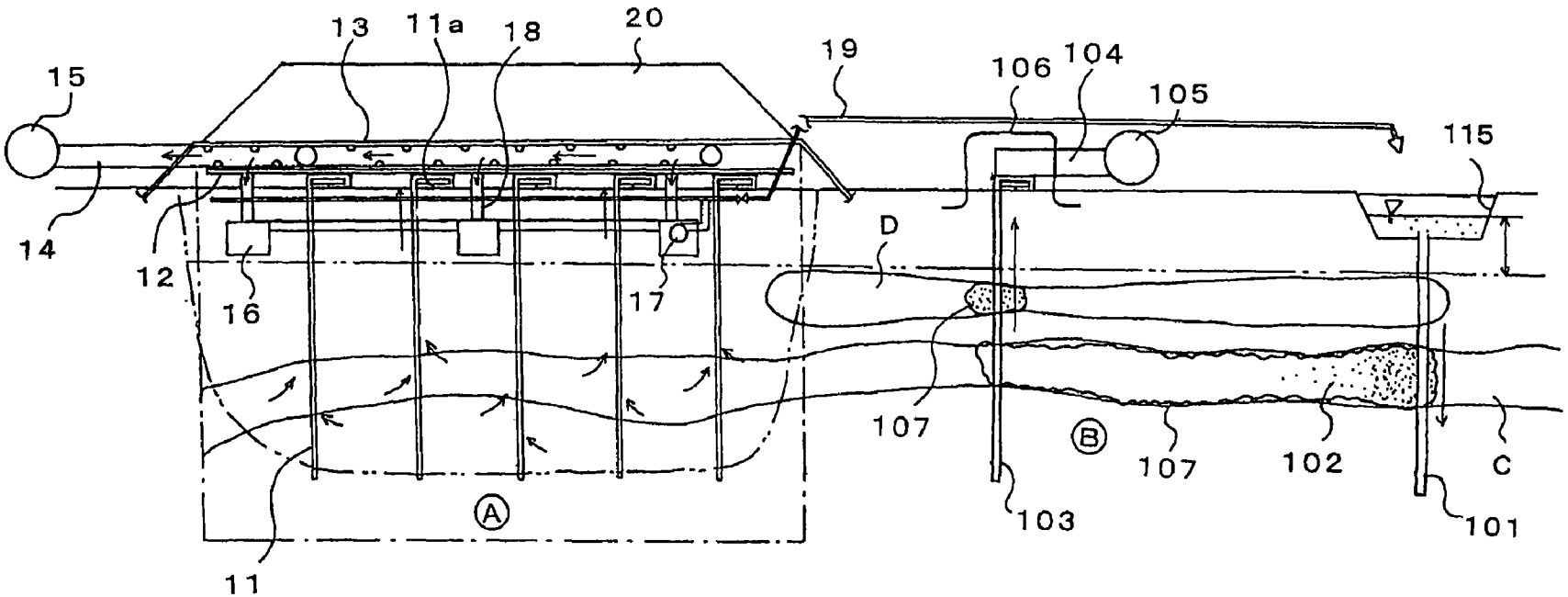
FIG. 11 is a schematic cross sectional diagram showing a water sealing zone formed between the ground to be improved and the peripheral ground according to an improving method of the present invention.
Figure 12:
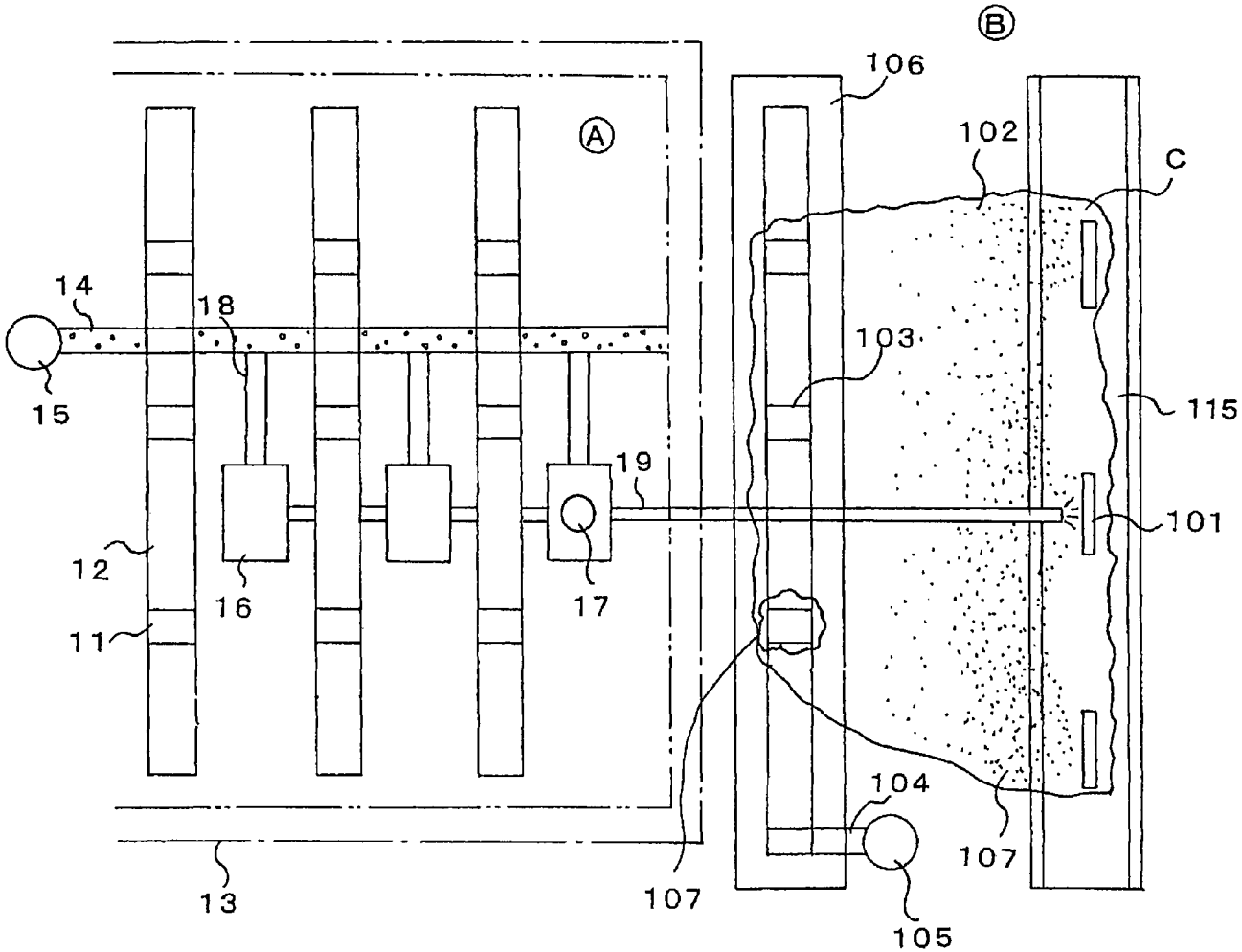
FIG. 12 is a schematic plan diagram showing the same water sealing zone as in FIG. 11.
Figure 13:
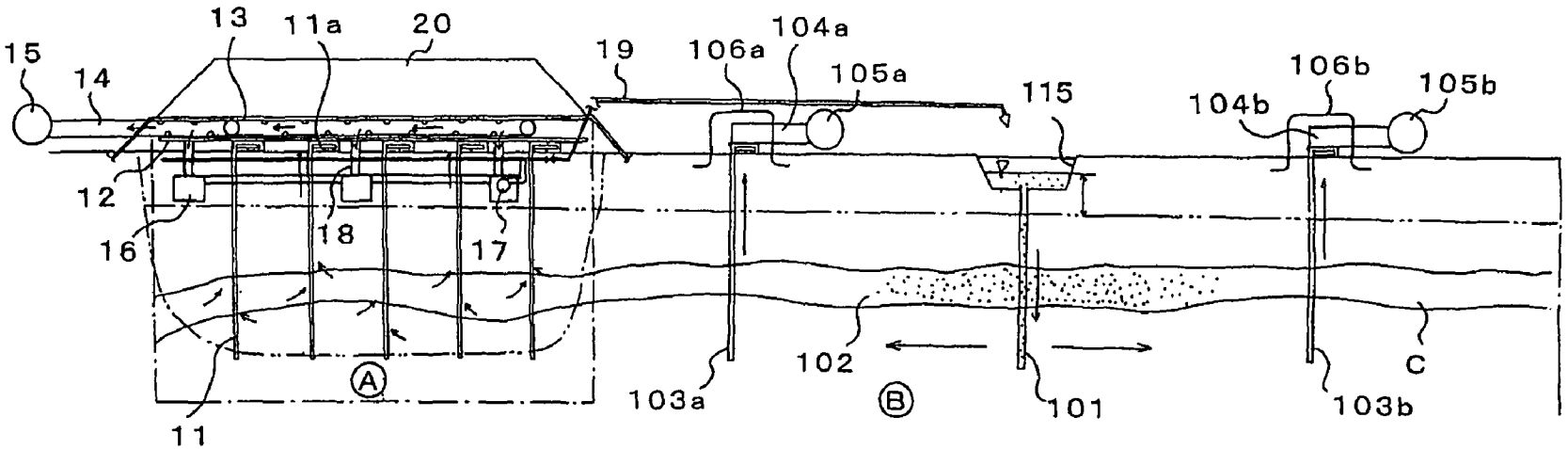
FIG. 13 is a schematic cross sectional diagram showing another example where the improving method of the present invention is applied, and the flow of water and a water sealing agent which is created by supplying the water sealing agent into vertical drains together with water and operating a vacuum pump.
Figure 14:
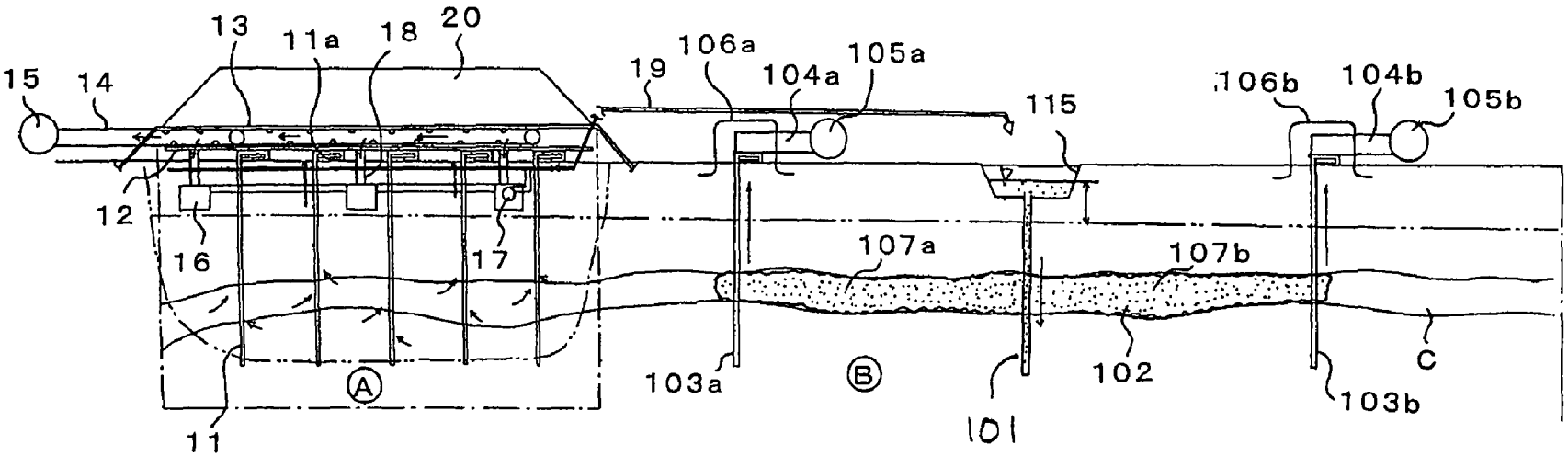
FIG. 14 is a schematic cross sectional diagram showing a water sealing zone formed within the peripheral ground in accordance with the improving method shown in FIG. 13.
Figure 15:
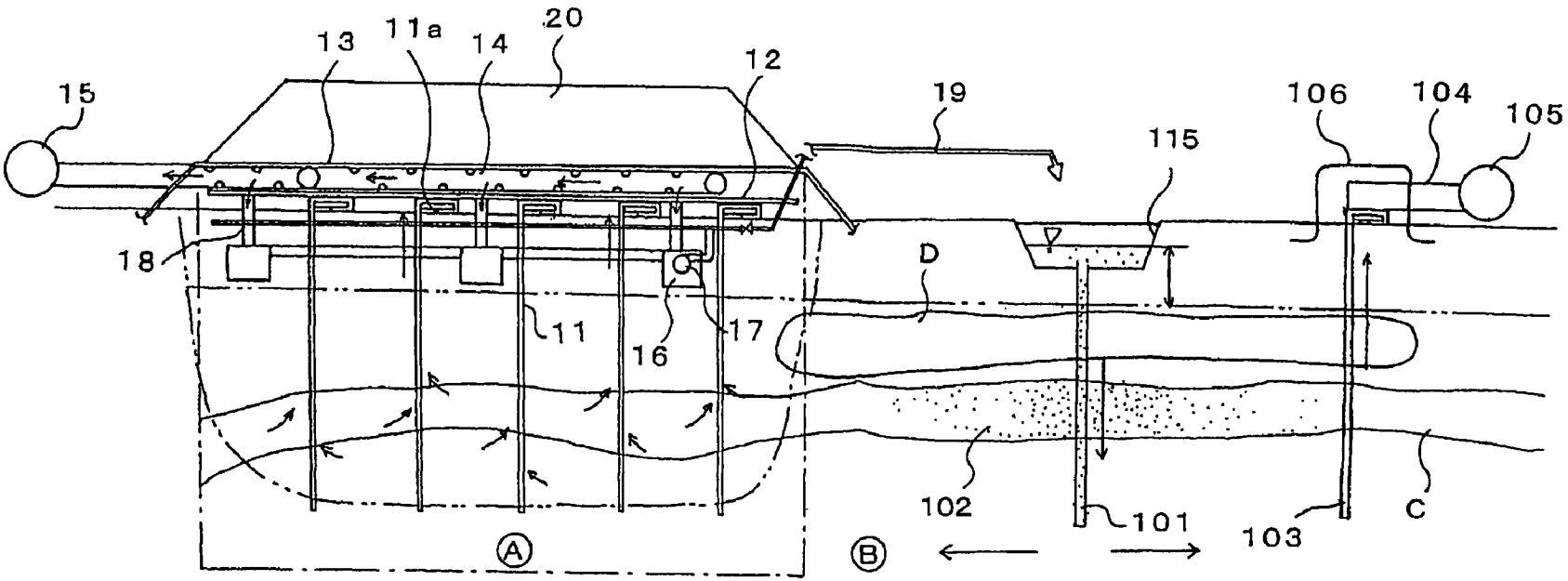
FIG. 15 is a schematic cross sectional diagram showing still another example where the improving method of the present invention is applied, and the flow of water and a water sealing agent which is created by supplying the water sealing agent into vertical drains together with water and operating a vacuum pump.
Figure 16:
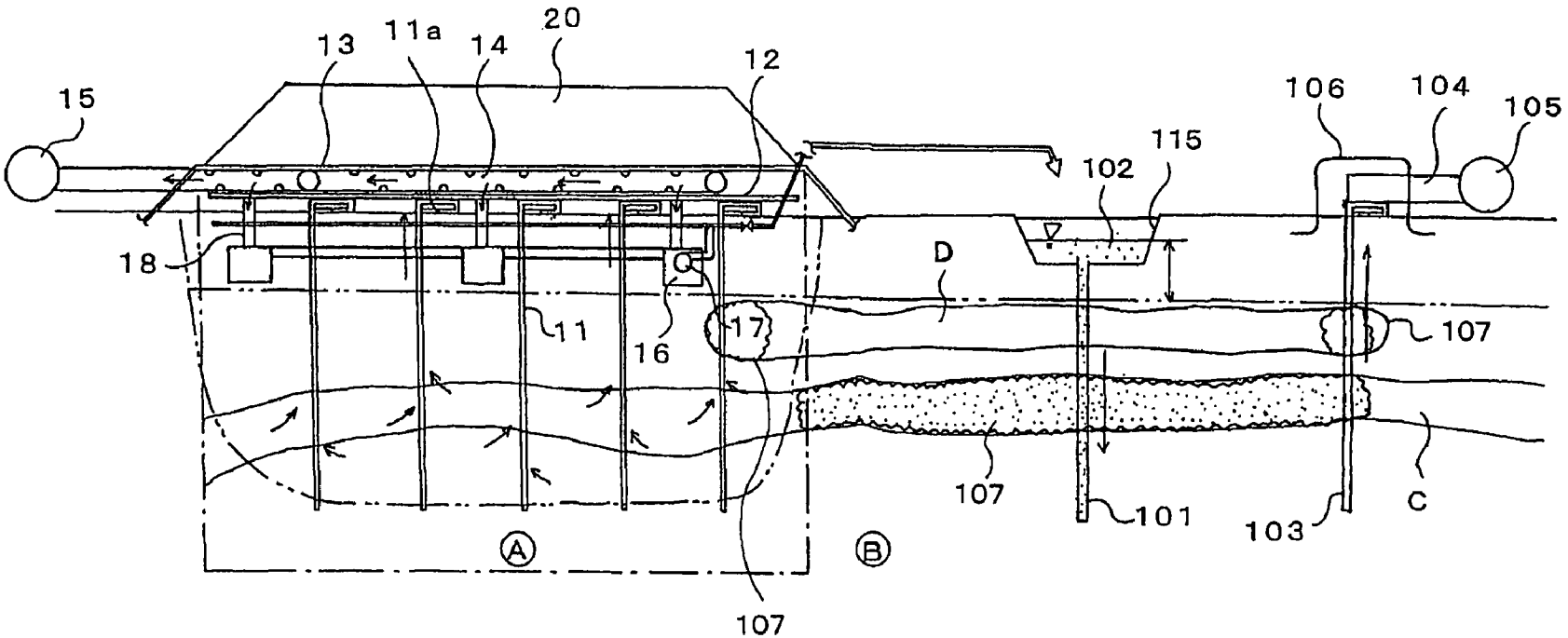
FIG. 16 is a schematic cross sectional diagram showing a water sealing zone formed within the peripheral ground in accordance with the improving method shown in FIG. 15.
Figure 17:
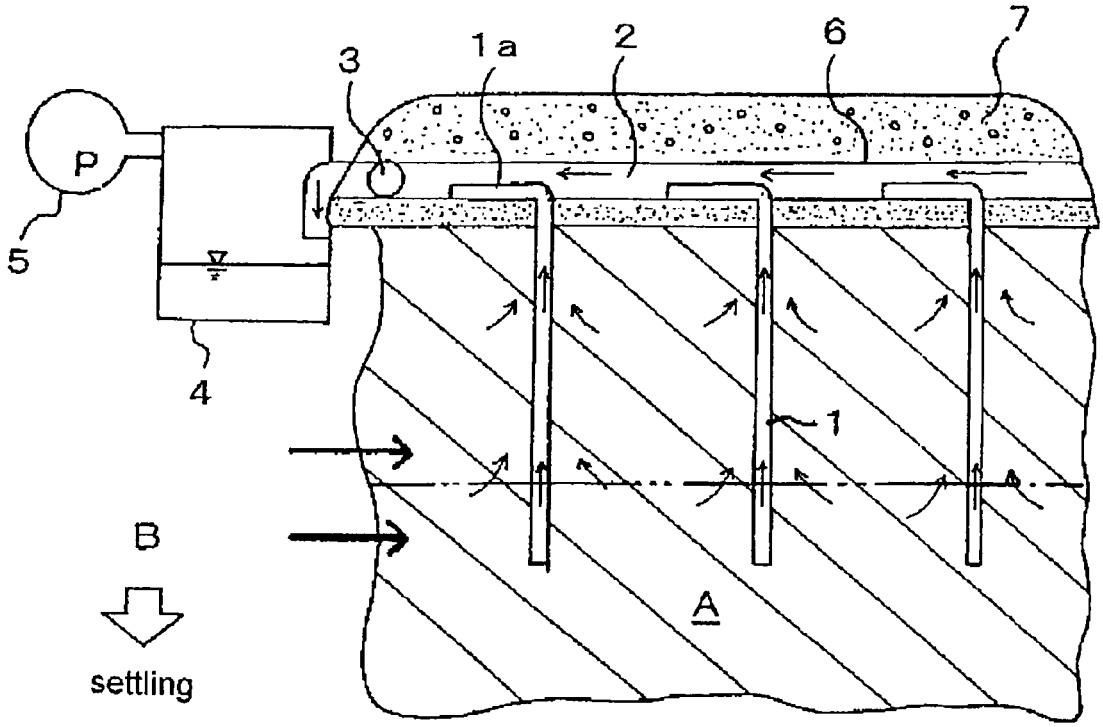
FIG. 17 is a schematic diagram showing an example where a conventional improving method is applied.

11, 102, 103, 103*a*, 103*b* vertical draining members
12, 104, 104*a*, 104*b* horizontal draining members
13, 106, 106*a*, 106*b* airtight sheet
15, 105, 105*a*, 105*b* vacuum pump
102 water sealing agent
107, 107*a*, 107*b* water sealing zone
108 water sealing tank
109 supply pipe
109*a* return pipe
110 floating check valve
111 layer made of gravel or coarse sand
112 frame
113 supply pipe
115 trench
A ground to be improved
B peripheral ground
C sand layer or organic soil layer having high water permeability
D middle gravel layer

The invention claimed is:

1. A method for improving soft ground, according to which a reduced pressure region that is isolated from the peripheral portion of the soft ground to be improved (hereinafter referred to as ground to be improved) is created using vacuum pressure within the ground to be improved, so that pore water in said ground to be improved is discharged, and thereby, said ground to be improved is converted to hard ground, characterized in that a vertical supply path is created in said ground to be improved and/or in the ground in the peripheral portion around the ground to be improved, and water containing a water sealing agent is supplied in the vertical supply path, so that the water containing a water sealing agent is supplied to the ground to be improved and/or the ground in the peripheral portion around the ground to be improved through the vertical supply path.

2. The method for improving soft ground according to claim 1, characterized in that the water containing a water sealing agent is a hydrophilic gel suspension.

3. The method for improving soft ground according to claim 2, characterized in that the hydrophilic gel is made of a polysaccharide salt.

4. The method for improving soft ground according to claim 3, characterized in that the polysaccharide salt is a salt a main component of which is CMC or sodium alginate.

5. The method for improving soft ground according to claim 1, characterized in that the water sealing agent is made of one or more types selected from among coarse sawdust, wood powder, rice husks, grain powder, bran or cereal of grains, starch, clay, cement and polymers having high water absorption.

6. The method for improving soft ground according to claim 5, characterized in that a nutrition component for microorganisms is added to the water containing a water sealing agent.

7. The method for improving soft ground according to claim 1, characterized in that the water sealing agent is a mixture where microorganisms are mixed into one or more types selected from among coarse sawdust, wood powder, rice husks, grain powder, bran or cereal of grains, starch, clay, cement and polymers having high water absorption.

8. The method for improving soft ground according to claim 1, characterized in that water containing said water sealing agent is supplied in to the vertical supply path from a water sealing agent tank for storing water containing a water sealing agent via a supply pipe.

9. The method for improving soft ground according to claim 8, characterized in that a floating type check valve is placed within the vertical supply path so that the supply of water containing a water sealing agent in the vertical supply path is blocked, accompanying an excessive supply of the water containing a water sealing material that is supplied from the water sealing agent tank via the supply pipe.

10. The method for improving soft ground according to claim 1, characterized in that the vertical supply path is created by driving a vertical draining member that is formed of a filter layer on the surface having textiles which allow the water sealing agent to pass into the ground to be improved and/or the ground in a peripheral portion of the ground to be improved.

11. The method for improving soft ground according to claim 1, characterized in that the vertical supply path is created within the ground to be improved and/or within the ground in a peripheral portion of the ground to be improved by providing a pipe having a large number of holes which allow the water sealing agent to pass in the direction of the depth.

12. The method for improving soft ground according to claim 1, characterized in that the water containing a water sealing agent is pore water from the ground to be improved.

13. The method for improving soft ground according to claim 12, characterized in that a trench or a pipe which is linked to a water discharge path for pore water from the ground to be improved is connected to the upper end portion of the vertical supply path.

14. The method for improving soft ground according to claim 12, characterized in that a layer made of gravel or coarse sand is provided around the upper end portion of a vertical draining member or pipe, and water containing a water sealing agent is supplied in this layer made of gravel or coarse sand.

15. A method for improving soft ground, according to which a reduced pressure region that is isolated from the peripheral portion of the ground to be improved is created using vacuum pressure within the ground to be improved, so that pore water in said ground to be improved is discharged, and thereby, said ground to be improved is converted to hard ground, characterized in that a vertical supply path is created in the ground in the peripheral portion around said ground to be improved, and water containing a water sealing agent is supplied in the vertical supply path, while a vertical water discharge path is created between the vertical supply path and the ground to be improved and/or outside said the vertical supply path, so that water within the ground in the peripheral portion around said ground to be improved is discharged through the vertical water discharge path.

16. The method for improving soft ground according to claim 15, characterized in that a plurality of vertical supply paths are created within the ground in a peripheral portion of the ground to be improved in broken line form.

17. The method for improving soft ground according to claim 15, characterized in that a plurality of vertical water discharge paths are created between a plurality of vertical supply paths and the ground to be improved in broken line form.

18. The method for improving soft ground according to claim 15, characterized in that the water containing a water sealing agent is a hydrophilic gel suspension.

19. The method for improving soft ground according to claim 18, characterized in that the hydrophilic gel is made of a polysaccharide salt.

20. The method for improving soft ground according to claim 19, characterized in that the polysaccharide salt is a salt a main component of which is CMC or sodium alginate.

21. The method for improving soft ground according to claim 15, characterized in that the water sealing agent is made of one or more types selected from among coarse sawdust, wood powder, rice husk, grain powder, bran or cereal of grains, starch, clay, cement and polymers having high water absorption.

22. The method for improving soft ground according to claim 21, characterized in that a nutrition component for microorganisms is added to the water containing a water sealing agent.

23. The method for improving soft ground according to claim 15, characterized in that the water sealing agent is a mixture where microorganisms are mixed into one or more types selected from among coarse sawdust, wood powder, rice husk, grain powder, bran or cereal of grains, starch, clay, cement and polymers having high water absorption.

24. The method for improving soft ground according to claim 15, characterized in that water containing said water sealing agent is supplied in to the vertical supply path from a water sealing agent tank for storing water containing a water sealing agent via a supply pipe.

25. The method for improving soft ground according to claim 24, characterized in that a floating type check valve is placed within the vertical supply path so that the supply of water containing a water sealing agent in the vertical supply path is blocked, accompanying an excessive supply of the water containing a water sealing material that is supplied from the water sealing agent tank via the supply pipe.

26. The method for improving soft ground according to claim 15, characterized in that the vertical supply path is created by driving a vertical draining member that is formed of a filter layer on the surface having textiles which allow the water sealing agent to pass into the ground.

27. The method for improving soft ground according to claim 15, characterized in that the vertical supply path is created by driving a vertical draining member that is formed of a filter layer on the surface having textiles through which it is impossible or difficult for the water sealing agent to pass into the ground.

28. The method for improving soft ground according to claim 15, characterized in that the water containing a water sealing agent is pore water from the ground to be improved.

29. The method for improving soft ground according to claim 28, characterized in that a trench or pipe which is linked to a water discharge path for pore water from the ground to be improved is connected to an upper end portion of the vertical supply path.

30. The method for improving soft ground according to claim 28, characterized in that a layer made of gravel or coarse sand is provided around an upper end portion of a vertical draining member, and water containing a water sealing agent is supplied in this layer made of gravel or coarse sand.

* * * * *